US007922776B2

(12) United States Patent
Zhang

(10) Patent No.: US 7,922,776 B2
(45) Date of Patent: Apr. 12, 2011

(54) METHOD OF PRODUCING FABRIC

(76) Inventor: Yu-Gao Zhang, Delta (CA)

( * ) Notice: Subject to any disclaimer, the term of this patent is extended or adjusted under 35 U.S.C. 154(b) by 437 days.

(21) Appl. No.: 10/281,781

(22) Filed: Oct. 28, 2002

(65) Prior Publication Data

US 2003/0135932 A1 Jul. 24, 2003

Related U.S. Application Data

(60) Provisional application No. 60/384,618, filed on May 30, 2002.

(30) Foreign Application Priority Data

Jan. 18, 2002 (CN) ..... 02 1 01957

(51) Int. Cl.
*D06M 16/00* (2006.01)
*D06M 11/00* (2006.01)
*D06M 13/322* (2006.01)

(52) U.S. Cl. ..... 8/116.1; 8/185; 435/263

(58) Field of Classification Search ..... 8/115.51, 8/116, 116.1, 185; 435/263
See application file for complete search history.

(56) References Cited

U.S. PATENT DOCUMENTS

| | | | | | |
|---|---|---|---|---|---|
| 3,666,399 | A | * | 5/1972 | Castrantas | 8/111 |
| 3,674,548 | A | * | 7/1972 | Gagarine | 442/93 |
| 3,794,465 | A | * | 2/1974 | Baron, Jr. | 8/115.6 |
| 3,926,717 | A | * | 12/1975 | Marchessault et al. | 162/157.6 |
| 4,295,847 | A | | 10/1981 | Petersen et al. | |
| 4,396,391 | A | * | 8/1983 | North | 8/181 |
| 4,912,056 | A | | 3/1990 | Olson | |
| 5,047,249 | A | * | 9/1991 | Rothman et al. | 424/543 |
| 5,135,542 | A | | 8/1992 | Sasakura et al. | |
| 5,232,851 | A | | 8/1993 | Cox et al. | |
| 5,320,645 | A | | 6/1994 | Logue et al. | |
| 5,350,423 | A | | 9/1994 | Davis, Jr. et al. | |
| 5,599,786 | A | | 2/1997 | Siklosi et al. | |
| 5,650,322 | A | | 7/1997 | Clarkson et al. | |
| 5,654,193 | A | * | 8/1997 | Clarkson et al. | 435/263 |
| 5,700,686 | A | | 12/1997 | Foody et al. | |
| 5,707,858 | A | | 1/1998 | Screws et al. | |
| 5,858,767 | A | | 1/1999 | Miettinen-Oinonen et al. | |
| 5,866,526 | A | * | 2/1999 | Olsen et al. | 510/392 |
| 5,873,909 | A | | 2/1999 | Brodmann et al. | |
| 5,874,293 | A | | 2/1999 | Miettinen-Oinonen et al. | |
| 5,908,472 | A | | 6/1999 | Vollmond | |
| 5,912,407 | A | | 6/1999 | Miller et al. | |
| 5,914,443 | A | | 6/1999 | Kalum | |
| 5,925,148 | A | | 7/1999 | Barfoed et al. | |
| 5,928,380 | A | | 7/1999 | Winkler et al. | |
| 5,948,122 | A | | 9/1999 | Xu et al. | |
| 5,964,939 | A | | 10/1999 | Fox et al. | |
| 5,972,042 | A | | 10/1999 | Barfoed et al. | |
| 5,980,581 | A | | 11/1999 | Patterson et al. | |
| 5,980,583 | A | | 11/1999 | Staub et al. | |
| 6,008,182 | A | | 12/1999 | Salsman et al. | |
| 6,015,707 | A | | 1/2000 | Emalfarb et al. | |
| 6,024,766 | A | | 2/2000 | Wasinger | |
| 6,036,729 | A | | 3/2000 | Barfoed et al. | |
| 6,042,616 | A | | 3/2000 | Yanai et al. | |
| 6,066,494 | A | | 5/2000 | Hsieh et al. | |
| 6,077,316 | A | | 6/2000 | Lund et al. | |
| 6,083,739 | A | | 7/2000 | Franks | |
| 6,102,973 | A | * | 8/2000 | Morales | 8/185 |
| 6,129,769 | A | | 10/2000 | Xu et al. | |
| 6,146,428 | A | | 11/2000 | Kalum et al. | |
| 6,162,260 | A | | 12/2000 | Liu et al. | |
| 6,165,919 | A | * | 12/2000 | Yang | 442/153 |
| 6,191,092 | B1 | * | 2/2001 | Bragulla et al. | 510/392 |
| 6,203,577 | B1 | | 3/2001 | Yanai et al. | |
| 6,258,590 | B1 | | 7/2001 | Lange et al. | |
| 6,268,196 | B1 | | 7/2001 | Fowler et al. | |
| 6,288,022 | B1 | | 9/2001 | Clark et al. | |
| 6,294,366 | B1 | | 9/2001 | Farrington et al. | |
| 6,296,672 | B1 | | 10/2001 | Barfoed et al. | |
| 6,300,259 | B1 | * | 10/2001 | Westland et al. | 442/153 |
| 6,302,922 | B1 | | 10/2001 | Kanehisa | |
| 6,754,919 | B2 | * | 6/2004 | Leaphart et al. | 5/417 |
| 2001/0037529 | A1 | * | 11/2001 | Igarashi et al. | 8/115.51 |
| 2004/0107506 | A1 | * | 6/2004 | Detering et al. | 8/115.51 |

FOREIGN PATENT DOCUMENTS

JP 404361669 A * 12/1992

OTHER PUBLICATIONS

Dickerson et al., "Evaluation of Selected Performance Characteristics of Naturally Colored Cotton Knit Fabrics," California Agricultural Technology Institute—Independent Projects Research Publications, Oct. 1996, http://www.cati.csufresno.edu/ip/rese.*
http://www.hunterlab.com/appnotes/an04_06.pdf.*

* cited by examiner

*Primary Examiner* — Lorna M Douyon
*Assistant Examiner* — Jaison P Thomas
(74) *Attorney, Agent, or Firm* — Andrew G. DiNovo; DiNovo Price Ellwanger & Hardy LLP

(57) ABSTRACT

Embodiments of the invention provide a method for manufacturing woven or knit fabrics with improved shrink and crease resistance and good shape memory after repeated washing. The method comprises (a) contacting an enzyme treatment composition with a cellulosic material (e.g., cotton fabric), the enzyme composition comprising an enzyme; and (b) treating the cellulosic material with a polymeric resin composition. Embodiments of the invention also provide a fabric manufactured by sequentially treating the fabric with an enzyme composition and a resin treatment agent.

16 Claims, No Drawings

METHOD OF PRODUCING FABRIC

CROSS-REFERENCE TO PRIOR APPLICATIONS

This patent application claims priority to U.S. Provisional Application Ser. No. 60/384,618, filed on May 30, 2002 and Chinese Patent Application No. 1957.6, filed on Jan. 18, 2002, the disclosures of both applications are incorporated by reference herein in their entirety.

FEDERALLY SPONSORED RESEARCH STATEMENT

Not applicable.

REFERENCE TO MICROFICHE APPENDIX

Not applicable.

FIELD OF THE INVENTION

The invention relates to a garment-manufacturing method, particularly a method of producing wrinkle-resistant fabric.

BACKGROUND OF THE INVENTION

Although cotton fabric possesses advantages of good elasticity, good moisture absorbability, breathability and comfort, they wrinkle easily during wearing and after laundering due to the breakage and deformation of the hydrogen bonds in the non-crystalline regions of the cellulose fibers by external forces or by the action of moisture, under which hydrogen bonds are once again formed. Especially after repeated laundering, there is a fuzzy appearance and a general fading of the clothes.

There have been many attempts to improve the quality of cotton fabrics. For example, prior art method involves the modification of the surface of cotton fabrics with either polymeric resins to resist wrinkling, or alternately with enzymes to obtain washing-resistance. However, there are no methods in the prior art that teach the use of a resin treatment agent in combination with an enzymatic treatment to improve the quality of cotton fabrics.

Ironing-free treatment includes selecting a suitable polymeric resin, applying the polymeric resin to the clothes, followed by drying and baking, to make the polymeric resin form stable chemical cross-linking between chains of the cellulose macromolecules and thereby improve the properties of deformation resistance and deformation restoration. Consequently, elasticity is increased and wrinkling is reduced.

One purpose of an enzyme treatment is to improve the quality of the finished goods by dehairing and smoothing. The enzymes commonly used for improving washing-resistance are hydrolases, such as cellulases and pectases, which hydrolyze exposed beta-1,4 bonds in cellulose and decompose the cellulose molecules to low molecular hydrolysates, such as cellobiose and glucose. This leads to removal of the fibrils, which are the most exposed part of the fabric. The removal of fibrils is believed to directly improve the softness of the garments and also to lead to better color and cleanliness, both by removing soil attached to the fibrils and by improving the penetration of other cleaning compounds being used. The removal of fibrils initially also helps to prevent a subsequent formation of fibrils. At the same time, results in strength loss of the cotton fabric to make fuzz and loose surface fibers, which re-occurred after wearing and washing, easily broken and removed. After repeated experiments, washing-resistance is improved by a single enzymatic treatment. However, after the enzymatic-treated fabric has been washed several times, the appearance of the washed fabric merits a rating of 2.0 to 3.0 on the ASTM scale, but cannot reach the desired rating of 4.0 according to ASTM testing method. When the cotton fabric is subjected to the enzymatic treatment several times, it results in weight loss of the cotton, serious strength loss of fabric and less improvement on washing-resistance. Besides, not only does this result in increased costs, the operations are also complicated due to the demanding requirements of the enzymatic treatment.

Traditional washing-resistant treatments for cotton fabrics include methods for polymeric resin treatment of cotton fabrics comprising the steps of, knitting, scouring, dyeing, soaping, fixing, softening, dehydrating, drying, heat-setting, making garments, applying a polymeric resin finish to the garments, tumble drying and testing. The traditional washing-resistant treatment includes methods for enzymatic treatment of cotton fabrics comprising the steps of knitting, scouring, dyeing, soaping, fixing, softening, dehydrating, drying, heat-setting, making garments, treating the garments with enzymes, tumble drying and testing.

Numerous tests have proved that either one of the above two methods, when used separately, are unable to achieve the good properties of both wrinkle-resistance and washing-resistance. In addition, as the two methods are operated on ready-to-be-worn clothes, the operation is complicated, less efficient and expensive.

Therefore there is a need to improve the existing methods in the art, which currently employ either a polymeric resin treatment agent or an enzymatic treatment.

SUMMARY OF THE INVENTION

The aforementioned need is met by embodiments of the invention in one or more of the following aspects. In one aspect, the invention relates to a method of producing a fabric. Preferably, the fabric is wrinkle-resistant and/or washing-resistant. The method comprises (a) contacting a cellulosic fabric with an enzyme composition; and, (b) treating the fabric with a resin treatment agent subsequent to the contacting step. In some embodiments, the enzyme composition comprises at least one enzyme or a mixture of two or more enzymes. The enzyme can be a hydrolase, oxidoreductase, or a mixture thereof. The hydrolase can be a pectase or cellulase. The resin treatment agent comprises a polymeric resin or a mixture of two or more polymeric resins. The polymeric resin can be selected from the group consisting of urea-formaldehyde (UF), methoxymethylol urea (MMU), thiourea formaldehyde (TUF), trimethylol melamime (TMM), methoxymethylol melamine (MMM), di-hydroxyl-methyl-ethylene urea (DMEU), di-hydroxyl-methyl-di-hydroxyl-ethylene urea (DMDHEU), di-hydroxyl-methyl-propyl urea (DMPU), di-hydroxyl-methyl-tri-zine ketone (DMT), modified N-methyl-di-hydroxyl-ethyl urea, polyhydric carboxylic acids, dimethylol urea (DMU), polyacrylate polymers, acrylonitrile, butyl acrylate, ethylene urea triazine (mixture of DMEU and hexamethylol melamine (HMM)); tetramethylol acetylene diurea (TMADU), triazone, uron and dimethyl dihydroxy ethylene urea (DMEDHEU). In some embodiments, the resin treatment agent comprises a reactive modified ethylene urea resin, a crosslinking acrylic copolymer and a catalyst. The crosslinking acrylic copolymer comprises a copolymer derived from butyl acrylate and acrylonitrile. In other embodiments, the resin treatment agent further comprises a catalyst, a strength protecting agent, a softener, a penetrating agent, or a combination thereof. The catalyst can be selected from the group consisting of ammonium chloride, aluminium chloride, ammonium salt of sulfuric salt, ammonium salt of nitric acid, ammonium salt of formic acid, mono-ammonium phosphate, diammonium phosphate, zinc nitrate, zinc chloride, magnesium chloride and fluorocarbon zinc salts. The strength protecting agent can be polyethylene; the softener can be selected from fatty acids and organosilicons; the penetrating reagent can be selected from polyoxyethylene ethers; the polyoxyethylene ether can comprise a low chain fatty alcohol.

In some embodiments, the enzyme composition is contacted with the fabric at an acidic pH range. The acidic pH range may range from about 3 to about 7. The acidic pH range can be achieved by contacting said enzyme composition with the fabric in the presence of an acid. Preferably, the acid is acetic acid. In other embodiments, the method may comprise one or more of the following steps: enzyme scouring, fabric dyeing, finishing, heat-setting, or a combination thereof. Preferably, the enzyme composition is present in a range of about 0.1 to about 2.5 g/l. The acetic acid is present in a range of about 0.4 to about 0.8 g/l. The enzyme composition is contacted with the fabric at a temperature of at least 35° C., such as from about 35° C. to about 60° C. The enzyme composition preferably is contacted with the fabric from about 10 to about 80 minutes. In some embodiments, the cellulosic fabric comprises cotton fibers. The polymeric resin is present in a range of about 20 to about 240 g/l. The catalysts are present in a range of about 5 to about 30 g/l. The strength protecting agents are present in a range of about 10 to about 50 g/l. The softeners are present in a range of about 10 to about 100 g/l. The penetrating agents are present in a range of about 0.5 to about 2.5 g/l.

In another aspect, the invention relates to a cotton fabric manufactured by sequentially treating the fabric with an enzyme composition and a resin treatment agent, wherein said fabric displays a grade of greater than 3.0 according to both ASTM and AATCC testing methods. The method described herein can be used to make such a fabric. Additional aspects of the invention and the characteristics and advantages of the invention are apparent with the following description.

BRIEF DESCRIPTION OF THE DRAWINGS

Not applicable.

DESCRIPTION OF EMBODIMENTS OF THE INVENTION

In the following description, all numbers disclosed herein are approximate values, regardless whether the word "about" or "approximate" is used in connection therewith. They may vary by 1 percent, 2 percent, 5 percent, or, sometimes, 10 to 20 percent. Whenever a numerical range with a lower limit, $R^L$ and an upper limit, $R^U$, is disclosed, any number falling within the range is specifically disclosed. In particular, the following numbers within the range are specifically disclosed: $R=R^L+k*(R^U-R^L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

It has now been discovered that wrinkle-free and washing-resistant cotton fabrics can be produced by a method that combines a polymeric resin treatment with an enzymatic treatment. Such a method changes the traditional treatments in order to realize the low costs and improve the properties of wrinkle-resistance and washing-resistance of fabrics, with high efficiency. It is a synergistic combination of the polymeric resin agent treatment and enzymatic treatment, rather than a simple combination of the two methods that produces unexpected improvements.

Accordingly, embodiments of the invention provide a method for manufacturing woven or knit fabrics having improved shrink and crease resistance and good shape memory following repeated washes. The method comprises (a) contacting a cellulosic material (e.g., cotton fabric) with an enzyme composition, wherein the enzyme composition comprises an enzyme; and (b) treating the cellulosic material with a polymeric resin composition. In an embodiment of the invention, the cellulosic material or fabric is sequentially treated with an enzyme composition followed by treatment with a resin treatment agent.

As used herein, the term "fabric" refers to a cloth or textile made by weaving, knitting, or felting cellulose-based fibers. As used herein, the term "enzyme composition" is a composition that comprises an enzyme. Enzymes are a group of proteins which catalyze a variety of typically biochemical reactions. Enzyme preparations have been obtained from natural sources and have been adapted for a variety of chemical applications. Enzymes are typically classified based on the substrate target of the enzymatic action. The enzymes useful in the compositions of this invention involve hydrolases and oxidoreductases. Hydrolases are enzymes that attack complex molecules, accelerating their digestion and yielding simpler substances. Since this process of digestion is referred to as hydrolysis, the enzymes that catalyze the process are considered to be "hydrolyzing enzymes" or "hydrolases".

The "hydrolase" group of enzymes comprises: (1) Amylases, which catalyze the digestion of starch into small segments of multiple sugars and into individual soluble sugars; (2) Proteases, (or proteinase), which split up proteins into their component amino acid building blocks; (3) Lipases, which split up animal and vegetable fats and oils into their component part: glycerol and fatty acids; (4) Cellulase (of various types) which breaks down the complex molecule of cellulose into smaller components of single and multiple sugars; (5) Beta-glucanase, (or gumase) which digest one type of vegetable gum into sugars and/or dextrins; and (6) Pectinase, which digests pectin and similar carbohydrates of plant origin.

Oxidoreductases are enzymes that catalyze electron transfer in oxidation-reduction reactions. Oxidoreductases are classified into several groups according to their respective donors or acceptors. Examples of oxidoreductases include, but are not limited to, oxidoreductases that act on the CH—OH group of donors; oxidoreductases that act on the aldehyde or oxo group of donors; oxidoreductases that act on the CH—CH group of donors; oxidoreductases that act on the CH—$NH_2$ group of donors; oxidoreductases that act on the CH—NH group of donors; oxidoreductases that act on NADH or NADPH; oxidoreductases that act on other nitrogenous compounds as donors; oxidoreductases that act on a sulfur group of donors; oxidoreductases that act on heme group of donors; oxidoreductases that act on diphenols and related substances as donors; oxidoreductases that act on a peroxide as acceptor; oxidoreductases that act on hydrogen as donor; oxidoreductases that act on single donors with incorporation of molecular oxygen (oxygenases); oxidoreductases that act on paired donors with incorporation of molecular oxygen; oxidoreductases that act on superoxide radicals as acceptor; oxidoreductases that oxidize metal ions; oxidoreductases that act on —$CH_2$— groups; oxidoreductases that act on reduced ferredoxin as donor; oxidoreductases that act on reduced flavodoxin as donor; and, other oxidoreductases. An example of a suitable oxidoreductase which may be used in an embodiment of the invention is laccase. Under the reactions employed in embodiments of the invention, laccase displays great robustness with minimum strength loss.

An embodiment of the invention employs an enzyme composition comprising one or more hydrolases. In another embodiment of the invention, the enzyme composition comprises only one hydrolase. In certain embodiments of the invention the enzyme compositions comprise cellulose hydrolases (cellulases). In other embodiments of the invention, the enzyme composition comprises pectases (pectinesterases). Certain embodiments of the invention employ an enzyme composition comprising a combination of cellulase and pectase. Certain embodiments of the invention employ a combination of a hydrolase and an oxidoreductase.

Cellulases are typically produced from bacterial and fungal sources which use cellulase in the degradation of cellulose to obtain an energy source or to obtain a source of structure during their life cycle. Examples of bacteria and fungi which produce cellulase are as follows: *Bacillus hydrolyticus, Cellulobacillus mucosus, cellulobacillus myxogenes, Cellulomonas* sp., *Cellvibrio fulvus, Celluvibrio vulgaris, Clostridium thermocellulaseum, Clostridium thermocellum, Corynebacterium* sp., *Cytophaga globulosa, Pseudomonas fluoroescens* var. *cellulosa, Pseudomonas solanacearum, Bacterioides succinogenes, Ruminococcus albus, Ruminococcus flavefaciens, Sorandium composition, Butyrivibrio, Clostridium* sp., *Xanthomonas cyamopsidis, Sclerotium bataticola, Bacillus* sp., *Thermoactinomyces* sp., *Actinobifida* sp., *Actinomycetes* sp., *Streptomyces* sp., *Arthrobotrys superba, Aspergillus aureus, Aspergillus flavipes, Aspergillus flavus, Aspergillus fumigatus, Aspergillus fuchuenis, Aspergillus nidulans, Aspergillus niger, Aspergillus oryzae, Aspergillus rugulosus, Aspergillus sojac, Aspergillus sydwi, Aspergillus tamaril, Aspergillus terreus, Aspergillus unguis, Aspergillus ustus*, Takamine-Cellulase, *Aspergillus saitoi, Botrytis cinerea, Botryodipiodia theobromae, Cladosporium cucummerinum, Cladosporium herbarum, Coccospora agricola, Curvuiaria lunata, Chaetomium thermophile* var. *coprophile, Chaetomium thermophile* var. *dissitum, Sporotrichum thermophile, Taromyces amersonii, Thermoascus aurantiacus, Humicola grisea* var. *thermoidea, Humicola insolens, Malbranchea puichella* var. *sulfurea, Myriococcum albomyces, Stilbella thermophile, Torula thermophila, Chaetomium globosum, Dictyosteiium discoideum, Fusarium* sp., *Fasarium bulbigenum, Fusarium equiseti, Fusarium lateritium, Fusarium lini, Fusarium oxysporum, Fusarium vasinfectum, Fusarium dimerum, Fusarium japonicum, Fusarium scirpi, Fusarium solani, Fusarium moniliforme, Fusarium roseum, Helminthosporium* sp., *Memnoniella echinata, Humicola fucoatra, Humicola grisea, Monilia sitophila, Monotospora brevis, Mucor pusillus, Mycosphaerella citrulina, Myrothecium verrcaria, Papulaspore* sp., *Penicillium* sp., *Penicillium capsulatum, Penicillium chrysogenum, Penicillium, frequentana, Penicillium funicilosum, Penicillium janthinellum, Penicillium luteum, Penicillium piscarium, Penicillium soppi, Penicillium spinulosum, Penicillium turbatum, Penicillium digitatum, Penicillium expansum, Penicillium pusitlum, Penicillium rubrum, Penicillium wortmanii, Penicillium variabile, Pestalotia palmarum, Pestalotiopsis westerdijkii, Phoma* sp., *Schizophyllum commune, Scopulariopsis brevicaulis, Rhizopus* sp., *Sporotricum carnis, Sporotricum pruinosum, Stachybotrys atra, Torula* sp., *Trichoderma viride* (*reesei*), *Trichurus cylindricus, Verticillium albo atrum, Aspergillus cellulosae, Penicillium glaucum, Cunninghamella* sp., *Mucor mucedo, Rhyzopus chinensis, Coremiella* sp., *Karlingia rosea, Phytophthora cactorum, Phytophthora citricola, Phytophtora parasitica, Pythium* sp., *Saprolegniaceae, Ceratocystis ulmi, Chaetomium globosum, Chaetomium indicum, Neurospora crassa, Sclerotium rolfsii, Aspergillus* sp., *Chrysosporium lignorum, Penicillium notatum, Pyricularia oryzae, Collybia veltipes, Coprinus sclerotigenus, Hydnum henningsii, Irpex lacteus, Polyporus sulphreus, Polyporus betreus, Polystictus hirfutus, Trametes vitata, Irpex consolus, Lentines lepideus, Poria vaporaria, Fomes pinicola, Lenzites styracina, Merulius lacrimans, Polyporus palstris, Polyporus annosus, Polyporus versicolor, Polystictus sanguineus, Poris vailantii, Puccinia graminis, Tricholome fumosum, Tricholome nudum, Trametes sanguinea, Polyporus schweinitzil* FR., *Conidiophora carebella*, Cellulase AP (Amano Pharmaceutical Co., Ltd.), Cellulosin AP (Ueda Chemical Co., Ltd.), Cellulosin AC (Ueda Chemical Co., Ltd.), Cellulase-Onozuka (Kinki Yakult Seizo Co., Ltd.), Pancellase (Kinki Yakult Seizo Co., Ltd.), Macerozyme (Kinki Yakult Seizo Co., Ltd.), Meicelase (Meiji Selka Kaisha, Ltd.), Celluzyme (Nagase Co., Ltd.), Soluble sclase (Sankyo Co., Ltd.), Sanzyme (Sankyo Co., Ltd.), Cellulase A-12-C (Takeda Chemical Industries, Ltd.), Toyo-Cellulase (Toyo Jozo Co., Ltd.), Driserase (Kyowa Hakko Kogyo Co., Ltd.), Luizyme (Luipold Werk), Takamine-Cellulase (Chemische Fabrik), Wallerstein-Cellulase (Sigma Chemicals), Cellulase Type I (Sigma Chemicals), Cellulase Serva (Serva Laboratory), Cellulase 36 (Rohm and Haas), Miles Cellulase 4,000 (Miles), R & H Cellulase 35, 36, 38 conc (Phillip Morris), Combizym (Nysco Laboratory), Cellulase (Makor Chemicals), Celluclast, Celluzyme, Cellucrust (NOVO Industry), and Cellulase (Gist-Brocades). Cellulase preparations are available from Accurate Chemical & Scientific Corp., Alltech, Inc., Amano International Enzyme, Boehringer Mannheim Corp., Calbiochem Biochems, Carolina Biol. Supply Co., Chem. Dynamics Corp., Enzyme Development, Div. Biddle Sawyer, Fluka Chem. Corp., Miles Laboratories, Inc., Novo Industrials (Biolabs), Plenum Diagnostics, Sigma Chem. Co., United States Biochem. Corp., and Weinstein Nutritional Products, Inc.

Cellulase, like many enzyme preparations, is typically produced in an impure state and often is manufactured on a support. The solid cellulase particulate product is provided with information indicating the number of international enzyme units present per each gram of material. The activity of the solid material is used to formulate the treatment compositions of this invention. Typically the commercial preparations contain from about 1,000 to 6,000 CMC (carboxymethyl cellulose) enzyme units per gram of product.

Pectin polymers are important constituents of plant cell walls. Pectin is a hetero-polysaccharide with a backbone composed of alternating homogalacturonan (smooth regions) and rhamnogalacturonan (hairy regions). The smooth regions are linear polymers of 1,4-linked alpha-D-galacturonic acid. The galacturonic acid residues can be methyl-esterified on the carboxyl group to a varying degree, usually in a non-random fashion with blocks of polygalacturonic acid being completely methyl-esterified.

Pectinases can be classified according to their preferential substrate, highly methyl-esterified pectin or low methyl-esterified pectin and polygalacturonic acid (pectate), and their reaction mechanism, beta-elimination or hydrolysis. Pectinases can be mainly endo-acting, cutting the polymer at random sites within the chain to give a mixture of oligomers, or they may be exo-acting, attacking from one end of the polymer and producing monomers or dimers. Several pectinase activities acting on the smooth regions of pectin are included in the classification of enzymes provided by the Enzyme Nomenclature (1992) such as pectate lyase (EC 4.2.2.2), pectin lyase (EC 4.2.2.10), polygalacturonase (EC 3.2.1.15), exo-polygalacturonase (EC 3.2.1.67), exo-polygalacturonate lyase (EC 4.2.2.9) and exo-poly-alpha-galacturonosidase (EC 3.2.1.82).

Pectate lyases have been cloned from different bacterial genera such as *Erwinia, Pseudomonas, Klebsiella* and *Xanthomonas*. Also from *Bacillus subtilis* (Nasser et al. (1993) FEBS 335:319-326) and *Bacillus* sp. YA-14 (Kim et al. (1994) Biosci. Biotech. Biochem. 58:947-949) cloning of a pectate lyase has been described. Purification of pectate lyases with maximum activity in the pH range of 8-10 produced by *Bacillus pumilus* (Dave and Vaughn (1971) J. Bacteriol. 108:166-174), *B. polymyxa* (Nagel and Vaughn (1961) Arch. Biochem. Biophys. 93:344-352), *B. stearothermophilus* (Karbassi and Vaughn (1980) Can. J. Microbiol. 26:377-384), *Bacillus* sp. (Hasegawa and Nagel (1966) J. Food Sci. 31:838-845) and *Bacillus* sp. RK9 (Kelly and Fogarty (1978) Can. J. Microbiol. 24:1164-1172) has been reported, however, no publication was found on cloning of pectate lyase encoding genes from these organisms. All the pectate lyases described require divalent cations for maximum activity, calcium ions being the most stimulatory.

Any pectinesterase from plants, bacteria or fungi, suitable for the degradation of pectin can be used in embodiments of the invention. Preferably, the pectinesterase is from fungal origin. More preferably, the pectinesterase is to obtained from *Aspergilli*, especially preferred is the use of pectinesterase obtained from *Aspergillus niger.*

In a preferred embodiment purified pectinesterase is used. This purification can be performed in different ways.

The crude enzyme may be purified for example by liquid chromatography (ion exchange, gel filtration, affinity) or by selective inhibition of the pectin depolymerases (pH shock, heat shock, chemical inhibitors, chemical or organic solvents extraction; see U.S. Pat. No. 2,599,531, which is fully incorporated by reference herein). Another source for obtaining purified pectinesterase as defined for the present application is pectinesterase obtained by recombinant DNA technology. An example of the use of recombinant DNA technology is the expression cloning of the *Aspergillus niger* pectinesterase. As expression host *Aspergillus niger* could be used. However, in view of the possible contamination of the pectinesterase with polygalacturonase, pectin lyase and other pectin depolymerases it may be preferable to use a heterologous host organism for producing the pectinesterase. Suitable host organisms include bacteria and fungi. Preferred species are *Bacilli, Escherichia, Saccharomyces, Kluyveromyces* and *Aspergilli.*

As used herein, the term "resin treatment agent" refers to a composition comprising a polymeric resin. In certain embodiments of the invention the resin treatment agent comprises two or more polymeric resins. In other embodiments of the invention, the resin treatment agent further comprises one or more of a catalyst, a strength protecting agent, a softener, and a penetrating reagent.

In certain embodiments, resin treatment agents comprise a crosslinking agent that is used to treat the fibers of fabrics. Early processes used formaldehyde as a crosslinking agent which, although effective, was highly odorous and undesirable to the consumer. Formaldehyde was replaced by reactive polymeric resins such as dimethylol urea (DMU), dimethylol ethylene urea (DMEU), and by modified ethylene urea resins, such as dimethylol dihydroxy ethylene urea (DMDHEU).

Certain resin treatment agents comprise one or more of a specialized resin system, a catalyst and buffers, a softener, a wetting agent, and a formaldehyde scavenger. For example, U.S. Pat. No. 3,926,550 to Harris et al., which is fully incorporated by reference. herein, teaches using tung oil to increase the abrasion resistance of cotton fabric. U.S. Pat. No. 3,666,400 to Lofton et al., which is fully incorporated by reference herein, discloses a durable press process which combines a durable polymer, such as a polyacrylate polymer, with a temporary polymer and DMDHEU to provide size to the fabric and to increase the abrasion resistance. U.S. Pat. No. 3,731,411 to Barber et al., which is fully incorporated by reference herein, teaches a copolymer of guanamine and an acrylic such as acrylonitrile, an addition type polymer such as butyl acrylate, and a glyoxal resin which impart durable press properties to cellulosic fabric and which attempt to diminish the loss of strength and abrasion resistance associated with the durable press process. The teachings in the above patents can be used in embodiments of the invention with or without modifications.

In certain embodiments of the invention, the resin treatment agent comprises a reactive modified ethylene urea resin, in combination with a crosslinking acrylic copolymer, and a catalyst. The crosslinking acrylic copolymer comprises a copolymer derived from butyl acrylate and acrylonitrile.

The polymeric resins used in the invention are capable of binding tightly to the surface of the fibers, yams, fabrics or garments. The polymeric resins are selected from the group consisting of urea-formaldehyde (UF), methoxymethylol urea (MMU), thiourea formaldehyde (TUF), trimethylol melamime (TMM), methoxymethylol melamine (MMM), di-hydroxyl-methyl-ethylene urea (DMEU), di-hydroxyl-methyl-di-hydroxyl-ethylene urea (DMDHEU), di-hydroxyl-methyl-propyl urea (DMPU), di-hydroxyl-methyl-tri-zine ketone (DMT), modified N-methyl-di-hydroxyl-ethyl urea, polyhydric carboxylic acids, dimethylol urea (DMU), polyacrylate polymers, acrylonitrile, butyl acrylate, ethylene urea triazine (mixture of DMEU and hexamethylol melamine (HMM)); tetramethylol acetylene diurea (TMADU), triazone, uron, dimethyl dihydroxy ethylene urea (DMEDHEU), other equivalent organic compounds and the modified ones thereof.

The catalysts facilitate the production of the resin treatment agent from constituent compounds including, but not limited to, reactive modified ethylene urea resin and a crosslinking acrylic copolymer. Suitable catalysts include Lewis acids. A "Lewis acid" is any atom, ion, or molecule which can accept electrons. Examples of Lewis acids include, but are not limited to, muriate of ammonia (ammonium chloride), aluminium chloride, ammonium salt of sulfuric salt, ammonium salt of nitric acid, ammonium salt of formic acid, mono-ammonium phosphate, diammonium phosphate, zinc nitrate, zinc chloride, magnesium chloride and fluorocarbon zinc salts. Other Lewis acids may also include, but not limited to, are metal halides including transition metal halides such as $TiCl_4$, $VCl_3$, and the like; and organometallic halides in which the metal atom belongs to the 2, 12, 13 and 14 groups of the Periodic Table of the Elements, as well as halides of the elements of 2, 12, 13, 14 and 15 groups of the Periodic Table of the Elements. Specific examples include, but are not limited to, methyl aluminum dichloride, methyl aluminum dibromide, ethyl aluminum dichloride, butyl aluminum dibromide, butyl aluminum dichloride, dimethyl aluminum bromide, dimethyl aluminum chloride, diethyl aluminum bromide, diethyl aluminum chloride, dibutyl aluminum bromide, dibutyl aluminum chloride, methyl aluminum sesquibromide, methyl aluminum sesquichloride, ethyl aluminum sesquibromide, ethyl aluminum sesquichloride, dibutyl tin dichloride, aluminum tribromide, antimony trichloride, antimony pentachloride, phosphorus trichloride, phosphorus pentachloride, boron tribromide, zinc dichloride, magnesium dichloride, and tin tetrachloride.

The strength protecting agents can be polyethylene or any polyethylene-containing compounds. The softeners are selected from fatty acids and organosilicons. The penetrating reagents are selected from polyoxyethylene ethers and JFCs (i.e., $RO(CH_2CH_2O)_nH$), wherein n is 0 or any positive integer).

The following U.S. patents disclose use of enzymes in fabric treatment, all of which are incorporated herein by reference: U.S. Pat. Nos. 4,912,056; 5,707,858; 5,908,472; 5,912,407; 5,914,443; 5,925,148; 5,928,380; 5,972,042; 6,024,766; 6,036,729; 6,077,316; 6,083,739; 6,083,739; 6,129,769; 6,146,428; 6,162,260; 6,258,590; 6,288,022; 6,302,922; 5,650,322; 5,700,686; 5,858,767; 5,874,293; 6,015,707; 6,066,494; 6,268,196; 6,294,366. The following U.S. patents disclose use of polymeric resins in fabric treatment, all of which are incorporated herein by reference: U.S. Pat. Nos. 5,350,423; 5,980,583; 6,008,182; 6,102,973; 4,912,056; 5,914,443; and 6,288,022. The enzymes and polymeric resins disclosed in the above patents and methods thereof can be used in various embodiments of the invention. As such, all of the preceding patents are incorporated by reference herein in their entirety. Moreover, additional enzymes, polymeric resins, and/or methods thereof are disclosed in the following U.S. Pat. Nos. 4,295,847; 5,135,542; 5,232,851; 5,599,786; 5,873,909; 6,042,616; 6,203,577; and 6,296,672, all of which are incorporated by reference herein in their entirety.

Some embodiments of the invention provide a method of producing a wrinkle-resistant, washing-resistant cellulosic fabric comprising, contacting the fabric with an enzyme composition; and treating the fabric with a resin treatment agent subsequent to the contacting step. In certain embodiments of the invention, the cellulosic fabric comprises cotton fibers.

Optional steps in which the cotton fabric is enzyme-scoured, washed, dyed, dehydrated, dried, finished with a finishing agent other than a resin treatment agent, and/or heat-set are used in some embodiments. Other embodiments incorporate a further optional step of garment making.

The enzyme scouring step removes oil, wax and other impurities from the cotton fabric and thus provides the fabric with a better wetting property during the dyeing process.

In the dyeing step, the fabric is treated with a natural or synthetic dye to achieve the desired coloration.

The finishing step comprises the treatment of the fabric with a "finishing agent" which imparts certain useful properties to the fabric including but not limited to, shrink resistance and a uniform soft feel. In certain embodiments of the invention the finishing agent used in the finishing step is a phosphorous amide compound.

Following treatment with the finishing agent, the fabric is typically subjected to a heat treatment or heat-set. The heat treatment may be carried out using any heat sources such as hot air, infrared rays, microwave and steam. Heat treating temperature is preferably 50° C. to 180° C., and heat treating time is preferably 1 to 30 minutes.

In certain embodiments of the invention, the enzyme composition is contacted with said fabric at an acidic pH range between about 3 to about 7. In an embodiment of the invention the acidic pH range is achieved by contacting the enzyme composition with the fabric in the presence of an acid. Examples of acids include but are not limited to hydrochloric acid, sulfuric acid, nitric acid and acetic acid.

The enzymatic treatment solution used to contact the fabric is most often an aqueous solution of a mixture of the enzymes and acetic acids. The amounts of said enzymes is from about 0.1 to about 2.5 g/l and the amounts of said acetic acid is from about 0.4 to about 0.8 g/l, which are adjustable according to needs in practice and the different parts of the knitwear. The bath ratio of the fabric to the mixture can fall within the range of about 1:8 to about 40. Reaction temperatures useful for enzyme compositions are governed by two competing factors. Firstly, higher temperatures generally correspond to enhanced reaction kinetics, i.e., faster reactions, which permit reduced reaction times as compared to reaction times required at lower temperatures. For cellulase and pectases, reaction temperatures are generally at least about 35° C. or greater. Secondly, these enzymes lose activity beyond a given reaction temperature which temperature is dependent on the nature of the enzyme used. Thus, if the reaction temperature is permitted to go too high, then the desired enzymatic activity is lost as a result of the denaturing of the enzyme. Cellulase and pectases, as exemplified herein, are preferably used at temperatures of from about 35° C. to about 60° C. In most cases, it is desirable to obtain effective treatment within a time frame of from about 10 to about 80 minutes.

The amounts of the reagents used in the polymeric resin treatment step are: polymeric resins of from 20 to 240 g/l, catalysts of from 5 to 30 g/l, strength protecting agents of from 10 to 50 g/l, softeners of from 10 to 100 g/l, and penetrating reagents of from 0.5 to 2.5 g/l, all of which are adjustable according to needs in practice and the different parts of the fabric.

The optional garment making step comprises the following steps: (1) an interlining is used and selected from non-woven thermal adhesive interlinings; the shrinkage of said interlining should be consistent with that of the fabric panel to avoid shrinkage of clothes after washing; (2) collar and sleeve should be properly tight or loose to compensate for the difference in shrinkage between them and other parts of the fabric when they are sewn; and (3) the stitches should not be too close to compensate different shrinkage between the threads and the fabric panel, and, (4) the threads cannot shrink too much.

Embodiments of the invention have one or more of the following advantages compared to traditional methods known in the art. The method, which combines the enzymatic treatment with the polymeric resin treatment, is used in embodiments of the invention for treating cotton fabric to impart an improved retention/restoration property than those imparted by prior art methods. Even after 20 separate instances of normal home laundering, the appearance i.e., the extent of pilling and the level of color remains the same as that before washing, with a rating of greater than 3.0 (or greater than 4 in some embodiments) according to both ASTM (American Society for Testing and Materials) and AATCC (American Association of Textile Chemists and Colorists) testing methods, without loose fibrils and protrusions that usually occurred in non-treated fabric, and in addition, there is less fading of clothes and improved shrinking-resistance.

The pilling resistance is graded using ASTM D3512 photographic standards and color change is graded using AATCC Evaluation Procedure 1 Gray Scale for Color Change.

The ASTM D3512 test method, which is fully incorporated by reference herein, is a standard test method for determining pilling resistance and other related surface changes of textile fabrics. This test method covers the resistance to the formation of pills and other related surface changes on textile fabrics using the random tumble pilling tester. The procedure is generally applicable to all types of woven and knitted apparel fabrics. Pilling and other changes in surface appearance, such as fuzzing, that occur in normal wear are simulated on a laboratory testing machine. Pills are caused to form on fabric by a random rubbing action produced by tumbling specimens in a cylindrical test chamber lined with a mildly abrasive material. To form pills with appearance and structure that resemble those produced in actual wear, small amounts of short-length gray cotton fiber are added to each test chamber with the specimens. The degree of fabric pilling is evaluated by comparison of the tested specimens with visual standards that may be actual fabrics, or photographs of fabrics, showing a range of pilling resistance. The observed resistance to pilling is reported using an arbitrary rating scale ranging from 5 (no pilling) to 1 (very severe pilling).

As used herein the term "fuzz" refers to untangled fiber ends that protrude from the surface of a yarn or fabric. The term "pilling resistance" refers to resistance to the formation of pills on the surface of a textile fabric. The term "pills" refers to the bunches or balls of tangled fibers which are held to the surface of a fabric by one or more fibers.

In certain embodiments of the invention, the ASTM and AATCC grades are at least 3.5. In other embodiments of the invention, the ASTM and AATCC grades are greater than 3.7. 4.0, 4.2, 4.5, 4.7, or 4.9.

The AATCC Evaluation Procedure 1 Gray Scale for Color Change, which is fully incorporated by reference herein, describes the use of a Gray Scale for evaluating changes in color of textiles resulting from colorfastness tests. The results of a colorfastness test is rated by visually comparing the difference in color or the contrast between the untreated and treated specimens with the differences represented a scale. The colorfastness grade is equal to the gray scale step which is judged to have the same color or contrast difference. As used herein the term "color change" refers to a change in color of any kind whether in lightness, hue or chroma, or any combination of these, discernible by comparing the test specimen with a corresponding untreated specimen. The term "colorfastness" refers to the resistance of a material to change in any of its color characteristics, to transfer of its colorant(s) to adjacent materials or both, as a result of the exposure of the material to any environment that might be encountered during the processing, testing, storing, or use of the material. The "Gray Scale" is a scale consisting of pairs of standard gray chips, the pairs representing progressive differences in color or contrast corresponding to numerical colorfastness grades. Colorfastness grade 5 is represented on the scale by two reference chips mounted side by side, neutral gray in color and having a Y tristimulus value of 12±1. The color difference of the pair is 0.0+0.2. Colorfastness grades 4.5 to 1, inclusive, are represented by reference chips like those used in Step 5 paired with lighter neutral gray chips of similar dimensions and gloss. The visual differences in the whole step pairs—colorfastness grades 4, 3, 2 and 1—are in geometric steps of color difference, or contrast as shown in the Table below. The differences in the half-step colorfastness grade pairs—4-5, 3-4, 2-3 and 1-2—are intermediate between the whole step pairs.

| Colorfastness Grade | Total Color Difference | Tolerance for Working Standards |
|---|---|---|
| 5 | 0.0 | +0.2 |
| 4-5 | 0.8 | +0.2 |
| 4 | 1.7 | +0.3 |
| 3-4 | 2.5 | +0.3 |

-continued

| Colorfastness Grade | Total Color Difference | Tolerance for Working Standards |
|---|---|---|
| 3 | 3.4 | +0.4 |
| 2-3 | 4.8 | +0.5 |
| 2 | 6.8 | +0.6 |
| 1-2 | 9.6 | +0.7 |
| 1 | 13.6 | +1.0 |

Examples 1 and 2 below which provide a comparison of methods that use either the enzymatic treatment (Example 1) or the polymeric resin treatment step (Example 2). The combination of the two treatments is used in Examples 3-5.

The following examples are presented to illustrate various embodiments of the invention and should not be construed to limit the invention as described herein.

EXAMPLE 1

A 30S/1 cotton pique 30 KG was employed to produce cotton knitwear only by resin treatment. The method comprised the following steps: knitting, scouring, dyeing, soaping, fixing, softening, dehydrating, drying, heat-setting, making garments, treatment with resins and tumble drying The amounts, the reaction conditions and the bath ratio of the resin, the catalyst, the strength protecting agent, the softener and the penetrating agent were kept in accordance with Example 3.

The mixture of the resin, catalyst, strength protecting agent, softener and penetrating reagent was employed in the resin treatment, wherein the resin was the modified di-hydroxyl-methyl-di-hydroxyl-ethylene urea, the catalyst was magnesium salt, the strength protecting agent was polyethylene, the softener was fatty acid and the permeable penetrating reagent was polyoxyethylene ether. Their amounts were:

Resin: 20 g/l
Catalyst: 5 g/l
Strength protecting agent: 20 g/l
Softener: 60 g/l
Penetrating reagent: 1.5 g/l The remaining steps were operated by traditional methods known in the art.

After 20 times of normal home laundering, the grade of pilling resistance was determined to be 1.5 by ASTM D3512 photographic standards and the grade of color change was determined to be 3.0 by AATCC Evaluation Procedure 1 Gray Scale for Color Change.

EXAMPLE 2

A 30S/1 cotton pique 30 KG was employed to produce cotton knitwear only by enzyme treatment. The method comprised the following steps: knitting, scouring, dyeing, soaping, fixing, softening, dehydrating, drying, heat-setting, making garments, treatment with enzymes and tumble drying The amounts, the reaction conditions and the bath ratio of the enzyme were kept in accordance with Example 3.

The mixture of the enzymes and acetic acid was employed in the enzymatic treatment, wherein the enzyme was cellulase (and/or pectases). The enzymatic treatment comprised treating the knitwear with a mixture of the enzyme and acetic acid in the bath ratio of the knitwear to the mixture from 1 to 10 with the temperature of 40° C. and time of 40 minutes. The amounts of the enzyme and the acetic acid were 0.5 g/l and 0.4 g/l, respectively.

The remaining steps were operated by traditional methods known in the art.

After 20 times of normal home laundering, the grade of pilling resistance is 2.5 by ASTM D3512 photographic standards and the grade of color change is 2.0 by AATCC Evaluation Procedure 1 Gray Scale for Color Change.

EXAMPLE 3

The 30S/1 cotton pique 30 KG was employed to produce the washing-resistant cotton knitwear. The method comprised the following steps: knitting, scouring, neutralizing, treating with enzymes, neutralizing, washing under high temperatures, dyeing, soaping, fixing, softening, dehydrating, drying, heat-setting, immersing in the polymeric resin, baking, making garments and testing.

The amounts, the reaction conditions and the bath ratio of the enzyme, the polymeric resin, the catalyst, the strength protecting agent, the softener and the penetrating agent were adjusted according to the yam count of the cotton as produced.

The mixture of the enzymes and acetic acid was employed in the enzymatic treatment, wherein the enzyme was cellulase (and/or pectases). The enzymatic treatment comprised treating the knitwear with a mixture of the enzyme and acetic acid in the bath ratio of the knitwear to the mixture from 1 to 10 with the temperature of 40° C. and time of 40 minutes. The amounts of the enzyme and the acetic acid were 0.5 g/l and 0.4 g/l, respectively.

The mixture of the polymeric resin, catalyst, strength protecting agent, softener and penetrating reagent was employed in the polymeric resin treatment, wherein the polymeric resin was the modified di-hydroxyl-methyl-di-hydroxyl-ethylene urea, the catalyst was magnesium salt, the strength protecting agent was polyethylene, the softener was fatty acid and the permeable penetrating reagent was polyoxyethylene ether. Their amounts were:

polymeric resin: 20 g/l
catalyst: 5 g/l
strength protecting agent: 20 g/l
softener: 60 g/l
penetrating regent: 1.5 g/l The remaining steps were operated by traditional methods known in the art.

After 20 times of normal home laundering, the grade of pilling resistance is 4.5 by ASTM D3512 photographic standards and the grade of color change is 4.5 by AATCC Evaluation Procedure 1 Gray Scale for Color Change.

EXAMPLE 4

The 40S/2 cotton lacoste 30 KG was employed to produce the washing-resistant cotton knitwear. The method was carried out as described in Example 3.

The mixture of the enzymes and acetic acid was employed in the enzymatic treatment, wherein the enzymes were cellulase (and/or pectases). The enzymatic treatment comprised treating the knitwear with a mixture of the enzymes and acetic acid in the bath ratio of the knitwear to the mixture from 1 to 30 with the temperature of 45° C. and time of 70 minutes. The amounts of the enzyme lotion and the acetic acid were 2.0 g/l and 0.8 g/l, respectively.

The mixture of the polymeric resin, catalyst, strength protecting agent, softener and penetrating reagent was employed in the polymeric resin treatment, wherein the polymeric resin was the modified N-methyl-di-hydroxyl-ethyl urea, the catalyst was magnesium salt, the strength protecting agent was polyethylene, the softener was organosilicon and the penetrating agent was polyoxyethylene ether. Their amounts were:

polymeric resin: 220 g/l
catalyst: 12 g/l
strength protecting agent: 45 g/l
softener: 20 g/l
penetrating regent: 1.0 g/l The remaining steps were operated by traditional methods known in the art.

After 20 times of normal home laundering, the grade of pilling resistance is 4.5 by ASTM D3512 photographic standards and the grade of color change is 4.0 by AATCC Evaluation Procedure 1 Gray Scale for Color Change.

EXAMPLE 5

The 40S/2 cotton interlock 30 KG was employed to produce the washing-resistant cotton knitwear. The method was carried out as described in Example 3.

The conditions of the method were adjusted: the mixture of the enzyme and acetic acid was employed in the enzymatic treatment, wherein the enzyme was cellulase (and/or pectases, laccases, etc.). The enzymatic treatment comprised treating the knitwear with a mixture of the enzyme and acetic acid in the bath ratio of the knitwear to the mixture from 1 to 40 with the temperature of 50° C. and time of 20 minutes. The amounts of the enzyme and the acetic acid were 1.0 g/l and 0.6 g/l, respectively.

The mixture of the polymeric resin, catalyst, strength protecting agent, softener and penetrating agent was employed in the polymeric resin treatment, wherein the polymeric resin was polyhydric carboxylic acid, the catalyst was phosphate, the strength protecting agent was polyethylene, the softener was the mixture of fatty acid and organosilicone, and the penetrating agent was JFC. Their amounts were:

polymeric resin: 100 g/l
catalyst: 20 g/l
strength protecting agent: 30 g/l
softener: 40 g/l
penetrating regent: 0.5 g/l The remaining steps were operated by traditional methods known in the art.

After 20 times of normal home laundering, the grade of pilling resistance is 4.0 by ASTM D3512 photographic standards and the grade of color change is 4.0 by AATCC Evaluation Procedure 1 Gray Scale for Color Change.

As demonstrated above, embodiments of the invention employ a method that combines the polymeric resin treatment with the enzymatic treatment to impart the cotton knitwear good retention/restoration properties. Even after 20 times of normal home launderings, the grade of the appearance i.e., pilling resistance and color, is 4.0 or higher according to both ASTM and AATCC testing methods, without loose fibrils and protrusions as usually occurs in untreated fabric. In addition, there is less fading of clothes and improved shrinking-resistance. Additionally, the method is easily operated, cost-effective and high efficient. High quality of cotton fabric is therefore achieved.

Although the invention has been described with respect to a limited number of embodiments, the specific features of a particular embodiment should not be attributed to other embodiments of the invention. No single embodiment is representative of all aspects of the invention. In certain embodiments of the invention, the disclosed compositions may further comprise numerous compounds and characteristics not mentioned herein. In other embodiments of the invention, the compositions do not include, or are substantially free of, one or more compounds or characteristics not enumerated herein. Variations and modifications from the described embodiments exist. For example, the method of making and using the disclosed invention is described as comprising a number of acts or steps. These steps or acts may be practiced in any sequence or order unless indicated otherwise. Finally, any use herein of a numerical value, should be construed to mean approximate, regardless of whether the word "about" or "approximately" is used in describing the numerical value. The appended claims are intended to cover all modifications and variations of the invention as falling within the scope of the invention.

What is claimed is:

1. A cotton fabric manufactured by sequentially treating said fabric with an enzyme composition and a resin treatment agent comprising modified di-hydroxyl-methyl-di-hydroxyl ethylene urea (DMDHEU), wherein said enzyme composition comprises a pectinesterase, wherein, even after 20 instances of normal home laundering, the fabric displays a pilling grade of greater than 3.0 according to ASTM D3512 and a colorfastness grade of greater than 3.0 according to AATCC Evaluation Procedure 1 Gray Scale for Color Change.

2. The cotton fabric of claim 1, wherein said enzyme composition further comprises a cellulase.

3. The cotton fabric of claim 1, wherein said an enzyme composition comprises a combination of a hydrolase and an oxidoreductases.

4. The cotton fabric of claim 1, wherein said pectinesterase is from a fungal origin.

5. The cotton fabric of claim 4, wherein said pectinesterase is obtained from an Aspergilli.

6. The cotton fabric of claim 5, wherein said Aspergilli comprises Aspergillus niger.

7. The cotton fabric of claim 1, wherein said pectinesterase is purified.

8. The cotton fabric of claim 7, wherein said pectinesterase is purified using liquid chromatography.

9. The cotton fabric of claim 7, wherein said pectinesterase is purified by selective inhibition of a pectin depolymerase.

10. The cotton fabric of claim 9, wherein said pectinesterase is purified using a recombinant DNA technology.

11. The cotton fabric of claim 7, wherein said pectinesterase is purified by expression cloning.

12. The cotton fabric of claim 11, wherein said pectinesterase comprises Aspergillus niger.

13. The cotton fabric of claim 1, wherein said resin treatment agent comprises a catalyst.

14. The cotton fabric of claim 13, wherein said catalyst comprises a metal halide selected from the group of $TiCl_4$ and $VCl_3$.

15. The cotton fabric of claim 13, wherein said catalyst comprises an organometallic halide.

16. A cotton fabric manufactured by sequentially treating said fabric with an enzyme composition and a resin treatment agent including a resin selected from the group of modified N-methyl-di-hydroxyl-ethyl urea and polyhydric carboxylic acid, wherein said enzyme composition comprises a pectinesterase, wherein, even after 20 instances of normal home laundering, the fabric displays a pilling grade of greater than 3.0 according to ASTM D3512 and a colorfastness grade of greater than 3.0 according to AATCC Evaluation Procedure 1 Gray Scale for Color Change.

* * * * *